US006748686B2

(12) United States Patent
Grate et al.

(10) Patent No.: US 6,748,686 B2
(45) Date of Patent: Jun. 15, 2004

(54) CHANNEL LETTER AND RETAINING CLIP THEREFOR

(76) Inventors: Anton Grate, 38 Coventry Chase, Joliet, IL (US) 60431; Cheryl Grate, 708 Cambridge La., Shorewood, IL (US) 60435

( * ) Notice: Subject to any disclaimer, the term of this patent is extended or adjusted under 35 U.S.C. 154(b) by 82 days.

(21) Appl. No.: 10/114,225

(22) Filed: Apr. 2, 2002

(65) Prior Publication Data

US 2002/0104241 A1 Aug. 8, 2002

Related U.S. Application Data

(63) Continuation-in-part of application No. 09/812,652, filed on Mar. 20, 2001, now Pat. No. 6,655,060, which is a continuation-in-part of application No. 09/241,644, filed on Feb. 1, 1999, now Pat. No. 6,202,333.

(51) Int. Cl.[7] ..... G09F 13/00
(52) U.S. Cl. ..... 40/575; 40/552
(58) Field of Search ..... 40/790, 781, 575, 40/552, 564, 716; 52/716.8, 716.1; 229/637, 649; 248/440, 40; 24/561, 562, 564

(56) References Cited

U.S. PATENT DOCUMENTS 1,697,501 A 1/1929 Gast
2,902,787 A 9/1959 Cook
4,443,508 A * 4/1984 Mehl ..... 428/122
4,695,499 A * 9/1987 Whitener ..... 428/122
4,796,170 A 1/1989 Pedersen

FOREIGN PATENT DOCUMENTS

FR 1091509 1/1954

* cited by examiner

*Primary Examiner*—Cassandra H. Davis
(74) *Attorney, Agent, or Firm*—Robert L. Marsh

(57) ABSTRACT

A channel letter has a rear surface for mounting against a raceway, wall, or a structure for supporting the signage, and sheet metal sides defining the figuration of the letter of shape to be depicted. A lighting element is positioned against the rear surface of the enclosure, and a lens is retained to the open front of the enclosure. The lens is retained by a plurality of retainer clips to a shoulder recessed within the walls of the enclosure and a cable between opposing walls provides lateral support to the walls. Each of the retainer clips has a first and a second leg extending from a back with the legs spaced a distance sufficient for the legs to fit around the end of the sheet metal of the walls. A partially flexible finger extends from one of the legs into the space between the legs so a to wedge against a surface of the sheet metal wall and thereby retain the retainer clip to the wall.

5 Claims, 3 Drawing Sheets

CHANNEL LETTER AND RETAINING CLIP THEREFOR

This is a Continuation-In-Part of our application filed Mar. 20, 2001 and assigned Ser. No. 09/812,652, now U.S. Pat. No. 6,655,060 which in turn was a Continuation-In-Part of our application filed Feb. 1, 1999 and assigned Ser. No. 09/241,644 now U.S. Pat. No. 6,202,333. The present invention relates to channel letters of the type used to create signage and, in particular, to an improved retainer clip for retaining the lens to the enclosure of a channel letter.

BACKGROUND OF THE INVENTION

Channel letters are used to provide signage for buildings, shopping malls, and the like where it is desirable that the signage comprise illuminated letters or any other shapes that are easily seen, even at great distances, day or night. Each channel letter consists of an enclosure, usually a metal box, having a rear surface which is positioned against a raceway, or the wall of a building, on which the signage is mounted and a plurality of sides which define the figuration of a letter or number which make up a portion of the sign. A light source, such as a neon tube, is positioned within the walls of the enclosure and attached to the rear surface to provide illumination for the letter.

The light sources used in existing channel letters are neon bulbs requiring high voltage power with transformers built into the metal enclosures. To prevent injury to those servicing such channels letters many municipalities require that such letters be inspected to ensure that they are adequately sealed using standards set by Underwriters Laboratories.

It is expected that new technology will soon be available for the manufacturers of channel letters. Specifically, low voltage LED type light sources have been developed which provide a very long lasting bright light without requiring the high voltage and transformers needed for neon lighting. It is expected that channel letters employing the new technology will not be required to meet the standards set by Underwriters Laboratories.

In addition to the lighting, a channel letter also includes a planar, transparent lens, the outer shape of which corresponds to the figuration of the letter or any other shape defined by the sides of the enclosure. The lens of existing channel letters have a trim cap glued to the outer edges thereof which form a border to the lens. The trim cap also has a lip which, when assembled to the enclosure, is shaped to fit snugly around the forward ends of the walls thereof for retaining the lens to the enclosure and to maintain the water tight seal required by Underwriters Laboratories. Screws are threaded through the lips of the trim cap and into the walls to retain the lens across the forward opening of the enclosure.

The manufacture of the lens requires that a planar panel of transparent plastic be cut to the shape of the enclosure and that the trim cap be glued to the outer edges of the lens. The contours of the sides of many letters are curved and the process of shaping and gluing the trim cap around the edges of the lens is labor intensive. It is, therefore, expensive to manufacture existing lenses which fit across the forward ends of the enclosure of a channel letter.

It would be desirable to provide a channel letter having a lens which could be manufactured without incurring the labor intensive step of attaching a trim cap. It would also be desirable to provide a less expensive method of manufacturing and assembling a lens to the enclosure of a channel letter.

SUMMARY OF THE INVENTION

Briefly, the present invention is embodied in a channel letter. For the purposes of this description, a channel letter is defined as an eliminated contoured fixture in the shape of a letter of the alphabet, a numeral, an element of punctuation such as a comma, an exclamation point, or any other shape or form intended to constitute a portion of a sign.

The channel letter of the present invention has a rear surface for mounting against a raceway, a wall, or any other structure suitable for supporting the signage. The walls defining the figuration of the letter or shape to be depicted are made of sheet metal having a given thickness. A lighting element, such as a strip of LEDs according to the newly available technology or any other light source, is positioned against the rear surface of the enclosure to provide illumination therefore.

To retain the lens to the open front of the enclosure, a shoulder, preferably made of foam or rubber, is provided around the inner surface of the sides thereof where the shoulder defines a plane parallel to the outer ends of the sides but is recessed therefrom. A planar transparent lens having an outer edge which is in the shape of the letter and sized to fit within the sides of the enclosure is retained against the shoulder by a plurality of retaining clips which fit around the edge of the sheet metal walls.

In accordance with the present invention to retain the lens against the shoulder a plurality of retainer clips are spaced along the outer end of the walls of the enclosure. Each of the retainer clips consists of a unitary generally ridged body having a first leg and a second leg with the legs extending from an arched back. The legs are spaced from each other by a distance that is a little greater than the given thickness of the sheet metal of the walls. At least one semi-ridged/semi-flexible finger extends from the surface of one of the legs and into the space between the legs. In the preferred embodiment the finger is made from polyurethane and the body of the retainer clip is made from a transparent polycarbonate. Also, the fingers are not perpendicular to the side walls of the legs from which they project, but are at an angle with respect to the perpendicular with a component of the angle extending toward the arched back. The angled orientation of the fingers permit the clip to be easily fitted over the outer ends of the enclosure but resist removal of the retainer clip once it has been installed. A plurality of such retainer clips positioned around the outer edge of the walls thereby attaching the lens to the walls of the enclosure.

To provide lateral support to the enclosure, one or more cables may be provided to connect opposite walls of the enclosure.

BRIEF DESCRIPTION OF THE DRAWINGS

A better and more complete understanding of the present invention will be had after a reading of the following detailed description taken in conjunction with the drawings wherein.

DETAILED DESCRIPTION OF THE PREFERRED EMBODIMENT

Figure 1:
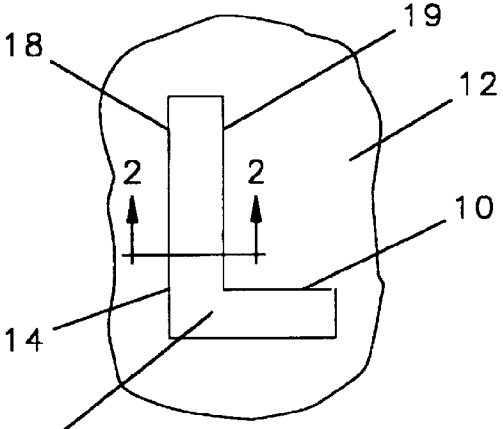
FIG. 1 PRIOR ART
FIG. 1 is a front elevational view of a prior art channel letter.
Figure 2:
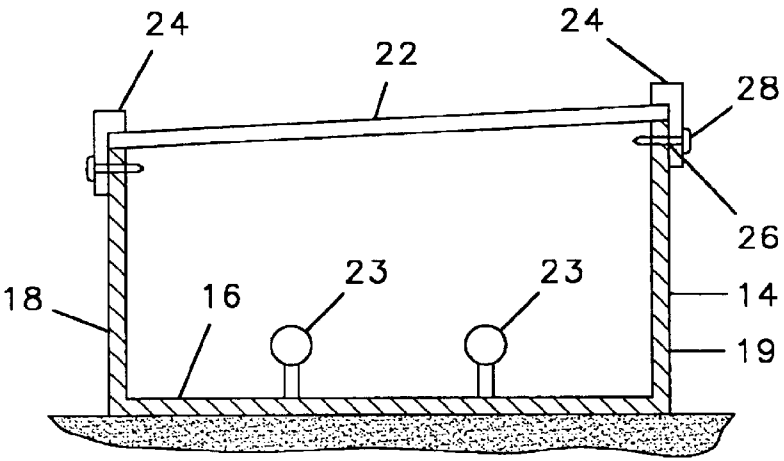
FIG. 2 PRIOR ART
FIG. 2 is an enlarged cross sectional view of the channel letter shown in FIG. 1 taken through line 2—2 thereof.

Referring to FIGS. 1 and 2, a channel letter 10 according to the prior art is mounted on a supporting structure 12. As shown, the channel letter 10 includes a metal enclosure 14 having a rear surface 16 and a plurality of side walls 18, 19 which are contoured to define the edges of a letter 10. The forward edges of the sidewalls 18, 19 define a plane and fitted across the forward edges is a transparent lens 22 having a shape corresponding to that defined by the walls 18,19 of the enclosure 14. Retained to the rear surface 16 of the enclosure 14 is a light source, which extends through the length of the channel letter 10 and illuminates the entire surface of the lens 22.

Referring further to FIG. 2, in accordance with the prior art, the lens 22 is retained to the side walls 18, 19 of the enclosure 14 by a trim cap 24, a plastic border member which is glued to the outer edges of the lens 22. The trim cap 24 has a rearwardly extending lip 26 that fits over the forward edges of the side walls 18, 19 and the trim cap 24 and the lens 22 are retained to the enclosure member 14 by a plurality of screws 28.

The manufacture of a channel letter 10 in accordance with the prior art requires the construction of the enclosure 14, the manufacture of a light fixture 23 and the lens 22. Manufacture of the lens 22 requires cutting a transparent acrylic material into the shape of the channel letter 10 and attaching the trim cap 24 around the edges thereof. The gluing of the trim cap 24 to the edges of the lens 22, however, must be carefully undertaken and is a time consuming, labor intensive process which adds significantly to the cost of the channel letter 10. The trim cap 24 is intended to meet the sealing standards set by Underwriters Laboratories, but such standards may not be needed for channel letters which employ the new LED technology. It would, therefore, be desirable to provide a less expensive method of attaching a lens 22 to the enclosure of the channel letter 10.

Figure 3:
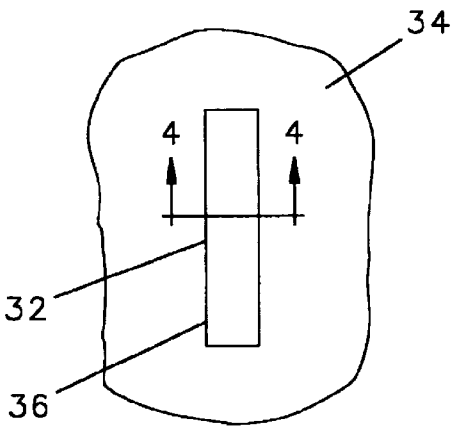
FIG. 3 is a front elevational view of a channel letter in accordance with the present invention.
Figure 4:
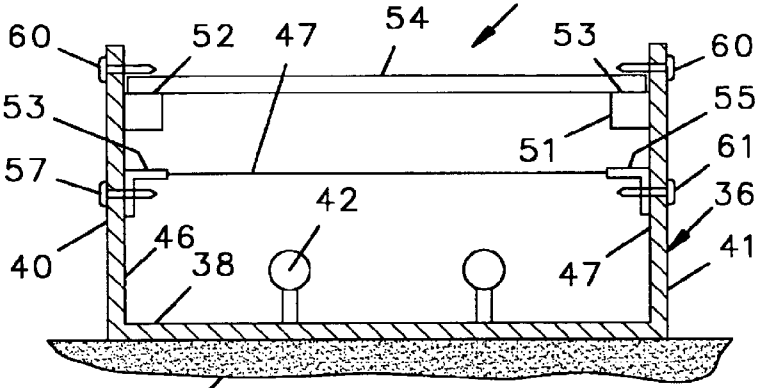
FIG. 4 is an enlarged cross sectional view of the channel letter shown in FIG. 3 taken through line 4—4 thereof.
Figure 5:
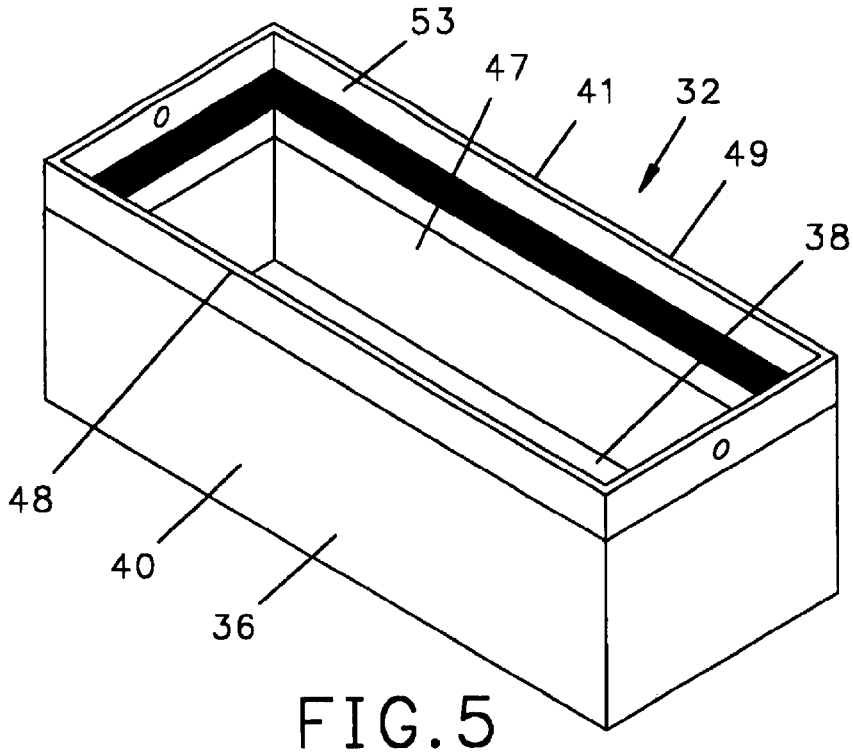
FIG. 5 is an isometric view of the enclosure of the channel letter shown in FIG. 3.

Referring to FIGS. 3, 4, and 5, a channel letter 32 in accordance with the present invention is attached to a supporting structure 34 and includes a metal enclosure 36 having a rear surface 38 and a plurality of sheet metal side walls 40, 41 according to the prior art. Fitted within the enclosure 36 is a suitable light source 42. Extending around the inner surface 46, 47 of the side walls 40, 41 and spaced a short distance from the forward ends 48, 49 thereof are shoulders 50, 51 with the forward surfaces 52, 53 of the shoulders defining a plane.

It should be appreciated that the least expensive method should be employed to provide the shoulders 50, 51 along the inner surfaces 46, 47. Rubber stripping, foam stripping, or any other suitable flexible material can be easily glued to the inner surface of the walls 40, 41 as shown to form the shoulders 50, 51.

The lens 54 for the channel letter 32 is cut from a planar panel of transparent acrylic with the outer edges 56 thereof having dimensions small enough to fit within the walls 40, 41 of the letter 32 and against the forward surfaces 52, 53 of the shoulders 50, 51. Extending around the perimeter of the lens 54 is a first plurality of retainers for retaining the lens 54 against the shoulder 50, 51. As shown in FIG. 4, the retainers may be simple screws 59 extending through the walls of the enclosure with the distal ends of the screws 59 forming a barrier for retaining the lens 54.

Referring to FIG. 2, since the trim cap 24 of a prior art channel letter 10 is firmly glued to the lens 22, and is also attached by the screws 28 to the outer ends of the walls 18, 19, the lens 22 and trim cap 24 provide lateral support to the walls 18, 19. The lens 54 of a channel letter 32 of the present invention prevents the walls 40, 41 from moving towards each other, but does not prevent the walls from bowing outward of each other. In the absence of a substitute method of providing lateral support it may be necessary to construct the walls 40, 41 of the enclosure 36 of a thicker gauge of metal.

Figure 6:
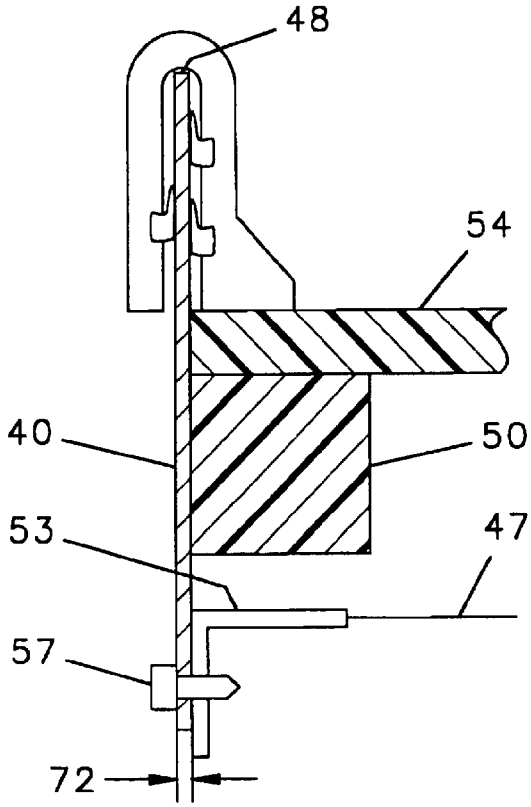
FIG. 6 is a fragmentary enlarged cross sectional view of the mounting of the lens in the enclosure shown in FIG. 5 employing a retainer clip in accordance with the present invention.

Referring to FIGS. 4 and 6, in accordance with the present invention one or more nylon connector cables 47 can be inserted to provide additional lateral support to the walls so to prevent the walls 40, 41 from bowing outward. The ends of each of the cables 47 are attached to bracket 53 and 55 mounted on walls 40 and 41 repectively and are held in place by any appropriate means such as screws 57, 61 respectively.

Figure 7:
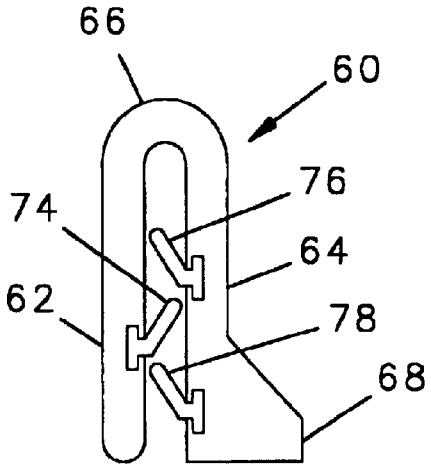
FIG. 7 is a side view of the retainer clip shown in FIG. 6.
Figure 8:
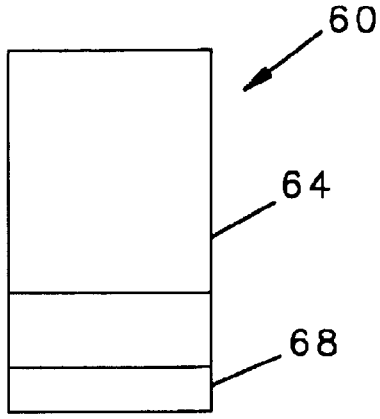
FIG. 8 is a front elevational view of the retainer clip shown in FIG. 6.

The screws 59 of the channel letter 32 may be judged as presenting an unattractive or unfinished appearance. Referring to FIGS. 6 through 8, to improve the appearance the screws 59 may be replaced with a plurality of retainer clips 60 spaced along the forward ends 48, 49 of the walls 40, 41 of the enclosure. Each retainer clip 60 consists of a molded body with a first leg 62 and a second parallel leg 64, the two legs 62, 64 extending from an arched back 66 with the legs 62, 64 and the back 66 formed as a unitary piece. At the free end of the second leg 64 is an outwardly protruding foot 68 the bottom surface of which rests on the outer surface of the lens 54 to retain it against the shoulder 50. The legs 62, 64 are spaced from each other a distance 70 which is greater than the thickness 72 of the sheet metal of the wall 40. Within the spacing between the legs 62, 64 and embedded in the material of the legs 62, 64 are a plurality of semi-rigid/semi-flexible fingers 74, 76, 78.

Figure 9:
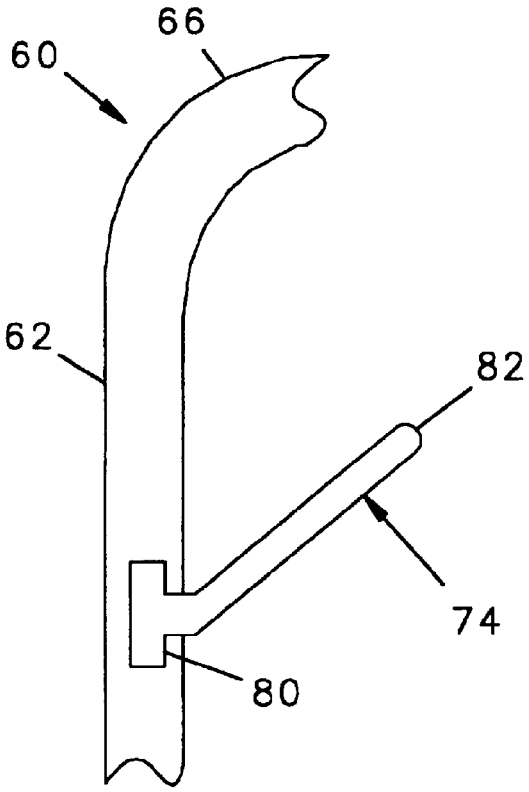
FIG. 9 is a fragmentary further enlarged side elevational view of the retainer clip shown in FIG. 6 depicting in detail the configuration of a finger thereof.

Referring to FIG. 9 in which finger 74 is representative of all the fingers 74, 76, 78, each finger 74 has a base 80 which is embedded into the material of the leg 62 and a free end 82 extending into the space between legs 62, 64. The free end 82 does not extent perpendicular to the surface of the leg 62, but is angularly orientated, sloping toward the back 66 as shown.

As best shown in FIG. 7, the fingers 74, 76, 78 may be positioned on either or both of the legs 62, 64 and are each finger 74, 76, 78 extends a distance of at least half the distance between the legs 62, 64. It should be appreciated that the walls 40, 41 of an enclosure 36 for a small channel letter will be made of a thinner gauge of metal than the walls of a larger channel letter, and therefor the spacing between the legs 62, 64 of a retainer clip 60 should be made to accept more than one gauge of metal. It should also be appreciated that the retainer clips 60 may be manufactured in more than one size with one size retainer clip 60 having a narrower spacing between the legs thereof than another size retainer clip 60.

Referring to FIG. 6, the retainer clip 60 is fitted on the forward end 48 of a wall 40 with the second leg 64 and the foot 68 extending over the lens 54. The retaining clip 60 can be easily installed because the fingers 74, 76, 78 will readily bend as the legs 62, 64 are moved along the opposing surfaces of the wall 40 until forward end 48 of the wall 40 is against the back 66 as shown. When all the retainer clips 60 have been installed along the walls of the enclosure 32 the feet 68 of the retainer clips 60 will rest on the outer surface of the lens 54 and retain the lens 54 against the forward surfaces 52 of the shoulders 50. Referring to FIGS. 6 and 9 in which finger 74 again being representative of all the fingers of a retainer clip 60, after a retainer clip 60 has been installed, the angularly oriented fingers will resist removal of the retainer clip. This is because friction between the surface of the wall 40 and the free end 82 of the fingers 74 will wedge the fingers 74 between the surface of the wall 40 and the associated leg 62.

Figure 10:
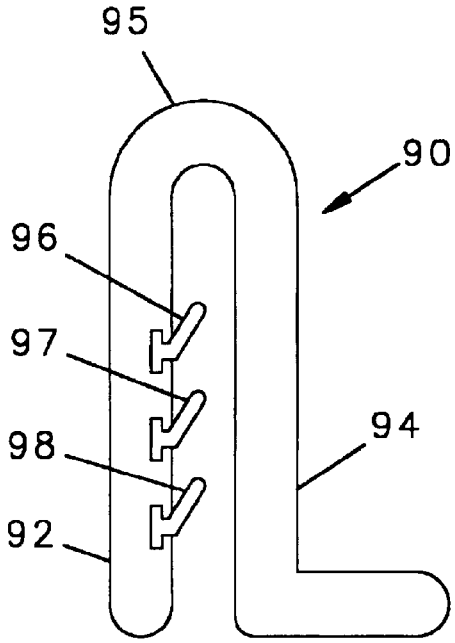
FIG. 10 is an enlarged side elevational view of a second embodiment of a retainer clip in accordance with the present invention.

The retainer clip 60 is depicted as having three fingers 74, 76, 78, with two fingers 74, 78 extending from leg 64 and one finger 76 extending from the other leg 64, but the fingers could be arranged differently on the legs of the retaining clip. Referring to FIG. 10 the retainer clip 90 is formed with first and second legs 92, 94, a back 95, and a plurality of fingers 96, 97, 98 all extending from the inner surface of only one leg 92.

The body of the retainer clip is preferably molded from a transparent plastic such as polycarbonate and the fingers a preferably made of a more flexible material such as polyurethane or nylon. When a channel letter 32 is assembled using transparent retainer clips 60 as described the finished product will present a more attractive appearance than one assembled using screws 59.

While two embodiments of the present invention have been disclosed, it will be appreciated that many modifications or variations may be made without departing from the true spirit and scope of the invention. It is, therefore, the intent of the pending claims to cover all such variations and modifications which fall within the true spirit and scope of the invention.

What is claimed:

1. A channel letter comprising an enclosure having at least two opposing walls made of sheet metal, said at least two opposing walls defining the shape of said letter and having an open front, said at least two opposing walls having an inner surface and a forward end, a shoulder on at least one of said inner surfaces of said at least two opposing walls, said shoulder on one of said inner surfaces defining a plane, said shoulder spaced from said forward ends of said at least two opposing walls, a planar transparent lens having a forward surface, and an outer edge in said shape of said letter and sized to fit within said at least two opposing walls of said enclosure and against at least a portion of said shoulder, a retainer means against said forward surface for retaining said lens within said enclosure and against said shoulder, a cable having two ends, one of said ends joined to each of said at least two opposing walls, and a light source within said enclosure.

2. A channel letter in accordance with claim 1 wherein said enclosure has a rear surface, and said inner surface of said walls extending without interruption from said rear surface to said forward end.

3. A channel letter in accordance with claim 1 wherein said retainer means comprises a plurality of retainer clips, each of said plurality of retainer clips having a mounting portion for attachment to said walls and a retaining portion for contacting said forward surface of said lens.

4. A channel letter in accordance with claim 3 wherein said retainer clip comprises a unitary rigid body having a first and a second leg, said first and second legs extending from a back, said first and second legs spaced from each other by a distance greater than said given thickness, and a finger of partially flexible material extending from said first leg and toward said second leg wherein said finger will wedge against a first surface of said sheet metal and resist removal thereof when said first leg is fitted against said first surface and said second legs is fitted against a second opposing surface of said sheet metal.

5. The combination comprising an enclosure for a channel letter having opposing walls made of sheet metal and having a given thickness, said opposing walls defining the shape of said letter and having an open front, said opposing walls having an inner surface and a forward end, a shoulder on at least one of said inner surfaces of said opposing walls, said shoulder on one of said inner surfaces defining a plane, said shoulder spaced from said forward ends of said opposing walls, a planar transparent lens having a forward surface, and an outer edge in said shape of said letter and sized to fit within opposing walls of said enclosure and against at least a portion of said shoulder, means attached to said walls and against said forward surface for retaining said lens within said enclosure and against said shoulder, a cable having two ends, one of said ends joined to each of two of said opposing walls, and a light source within said enclosure.

* * * * *